US010100526B2

(12) United States Patent
Knudson

(10) Patent No.: US 10,100,526 B2
(45) Date of Patent: Oct. 16, 2018

(54) MODULAR SHELVING AND STEP ASSEMBLY

(71) Applicant: Edward A. Knudson, Circle Pines, MN (US)

(72) Inventor: Edward A. Knudson, Circle Pines, MN (US)

( * ) Notice: Subject to any disclaimer, the term of this patent is extended or adjusted under 35 U.S.C. 154(b) by 0 days.

(21) Appl. No.: 15/154,589

(22) Filed: May 13, 2016

(65) Prior Publication Data

US 2016/0331135 A1 Nov. 17, 2016

Related U.S. Application Data

(60) Provisional application No. 62/162,773, filed on May 17, 2015.

(51) Int. Cl.
*A47B 85/00* (2006.01)
*A47B 47/00* (2006.01)
(Continued)

(52) U.S. Cl.
CPC ..... *E04F 11/035* (2013.01); *A47B 47/0083* (2013.01); *A47B 47/0091* (2013.01);
(Continued)

(58) Field of Classification Search
CPC ..... A47B 47/0091; A47B 87/00; E04F 11/035
See application file for complete search history.

(56) References Cited

U.S. PATENT DOCUMENTS 4,237,798 A 12/1980 Welsch et al.
4,567,989 A 2/1986 Hurst
(Continued)

FOREIGN PATENT DOCUMENTS

EP 2723729 A1 4/2014
EP 2 732 729 A1 5/2014

OTHER PUBLICATIONS

Global Industrial Online Catalogue,Item T9F269466, Sterilite Plastic 4-Shelf Shelving 34-1/2"W x 14-38"D x 57"H, Available online at http://www.globalindustrial.com/p/storage/shelving/plastic/plastic-4-shelf-shelving-34-1-2in-w-x14-3-8in-d-x57in-h, Available Oct. 26, 2014, Retrieved Oct. 26, 2014, 3 pages.
(Continued)

*Primary Examiner* — Stanton L Krycinski
(74) *Attorney, Agent, or Firm* — Krenz Patent Law, LLC

(57) ABSTRACT

An assembly includes a plurality of shelving components and posts. The shelving components include a body, a male portion that extends from a first end of the body and a female portion that defines a void in an opposite, second end. The male portion is narrower and shorter than the body. The female portion is sized and shaped to receive the male portion of another shelving component. The shelving components also include first apertures defined by and extending through the male portion, and second apertures defined by and extending through the female portion. The posts are sized and shaped to be inserted into overlapping apertures of first and second shelving components, the overlapping apertures comprising (i) a first aperture in a male portion of the first component inserted into a female portion of the second component and (ii) a second aperture in the female portion of the second component.

20 Claims, 14 Drawing Sheets

(51) Int. Cl.

| | |
|---|---|
| ***E04F 11/032*** | (2006.01) |
| ***E04F 11/035*** | (2006.01) |
| ***E04F 11/17*** | (2006.01) |
| ***E04F 11/18*** | (2006.01) |
| ***E04F 11/104*** | (2006.01) |
| *E04F 11/02* | (2006.01) |

(52) U.S. Cl.
CPC ... *E04F 11/1043* (2013.01); *E04F 2011/0218* (2013.01); *E04F 2011/1821* (2013.01)

(56) References Cited

U.S. PATENT DOCUMENTS

| | | | | |
|---|---|---|---|---|
| 4,930,643 | A * | 6/1990 | Flum | A47B 87/0223 211/188 |
| 5,218,914 | A | 6/1993 | Dickinson | |
| 5,400,719 | A * | 3/1995 | Santapa | A47B 87/0223 108/182 |
| D383,014 | S * | 9/1997 | Sagol | D6/675.1 |
| 5,683,004 | A * | 11/1997 | Aho | F16M 11/24 108/106 |
| 5,964,163 | A * | 10/1999 | Cohen | A47B 49/004 108/186 |
| 6,015,050 | A | 1/2000 | Gilbertson | |
| 6,152,553 | A * | 11/2000 | Wunderlich | A47B 47/0091 108/110 |
| 6,155,435 | A * | 12/2000 | Malik | A47B 57/26 108/64 |
| 6,202,867 | B1 * | 3/2001 | Di Blasi | A47B 47/0075 108/138 |
| 6,273,281 | B1 | 8/2001 | Berglund | |
| 6,520,356 | B2 * | 2/2003 | Miller, Jr. | A47F 5/0018 108/106 |
| 6,601,715 | B2 * | 8/2003 | Hardy | A47B 87/0246 211/188 |
| 6,877,828 | B2 | 4/2005 | Strong | |
| 6,948,435 | B1 * | 9/2005 | Sheng | A47B 47/0016 108/180 |
| 7,231,740 | B2 | 6/2007 | Jirele | |
| 7,770,743 | B1 * | 8/2010 | Janowak | A47G 7/042 108/92 |
| 8,141,723 | B2 * | 3/2012 | Whalen | A47B 47/045 211/135 |
| 9,332,865 | B1 * | 5/2016 | Mason | A47F 5/10 |
| 9,370,242 | B2 * | 6/2016 | Guizzardi | A47B 87/0223 |
| 9,538,846 | B2 * | 1/2017 | Reinhart | A47B 96/02 |
| 2002/0046982 | A1 * | 4/2002 | Guizzardi | A47B 57/545 211/187 |
| 2002/0073902 | A1 | 6/2002 | Jipp | |
| 2004/0159622 | A1 * | 8/2004 | Craft | A47B 87/0246 211/153 |
| 2007/0045209 | A1 * | 3/2007 | Richardson | A47B 87/0223 211/187 |
| 2008/0053940 | A1 * | 3/2008 | Whalen | A47B 47/045 211/134 |
| 2014/0008316 | A1 | 1/2014 | Zabicka | |

OTHER PUBLICATIONS

HDX, Home Depot Online Catalogue Model #17601099, 5-Shelf 36 in. W x 72 in D Plastic Ventilated Storage Shelving Unit, Available Online at http://www.homedepot.com/ . . . -Unit-17601099/100010588?cm_mmc=SEM%7cG%7cBT3%7cPLA&gclid=CK6An9KMy8ECFbPm7AodYi0A8g&gclsrc=aw.ds#specifications, Available Oct. 26, 2014, Retrieved Oct. 26, 2014, 5 pages.

Home Depot Online Catalogue Stalwart Model # 82 VY034 19-Compartment Plastic Corner Storage Tool Rack Tower in Green, Available at http://www.homedepot.com/s/stalwart%252019-compartment%2520storage?NCNI-5, Available Oct. 26, 2014, retrieved Oct. 26, 2014, 3 pages.

Iceberg Black Rough-N-Ready 4-Shelf Open Storage System, Available Online at https://www.google.com/shopping/product/7377640846824829 51?q=plastic+shelf+home+depot&hl=en&gbv=2&prmd=ivns&sa=X&ei=s1BNVLNgx5ODBOumgNAF&ved=0CCwQ8wlwAQ#specs, Available Oct. 26, 2014, Retrieved Oct. 26, 2014,, 2 pages.

Katom restaurant Supply, Inc. Online Catalogue Item Rubbermaid FG9T3900BLA Xtra Shelving Unit, 5 Shelves w/ Metal supports, 71-3/8 in H, Black Model 077-9T39, Available at http://www.katom.com/007-9T39.html, Apr. 5, 2011, Retrieved Oct. 26, 2014, 1 page.

Plano 4-Shelf Storage Unit, Light Taupe—Walmart.com Online Catalogue, Available at http://www.walmart.com/ip/8251818?wmlspartner=wlpa&adid=22222222227001195601 8m10=&w11=g8m12==c&w13=40876482752&w14=&w15+pla&w16=7876722807&veh=sem, Available Oct. 26, 2014, Retrieved Oct. 26, 2014, 7 pages.

SPC Industrial Online Catalogue, Shelving Systems, Available at http://www.spcindustrial.com/shelving.html, Dec. 16, 2013, Retrieved Oct. 26, 2014, 4 pages.

Sterilite 5-Shelf Shelving unit, Light Platinum, Available Online at https://www.google.com/shopping/product/3311812086264094256?q=plastic+shelf+home+depot&hl=en&gbv=2&prmd=ivns&sa=X&ei=IVVNVMHxMorOggT-_IHABQ&ved=0CGsQ8wlwEzgU, Available Oct. 26, 2014, Retrieved Oct. 26, 2014, 2 pages.

Coopenheaver, Blaine R., Authorized Officer USPTO, International Search Report and Written Opinion, International Application No. PCT/US16/32681, dated Aug. 12, 2016, 11 pages.

Nickitas-Etienne, Athina, Authorized Officer the International Bureau of WIPO, International Preliminary Report on Patentability, dated Nov. 21, 2017, International Application No. PCT/US16/32681,10 pages.

* cited by examiner 102
103b
104
105
106
108
110
112

500
502
502a
502b
502c
504
506
508
510
102
104
110
112
505

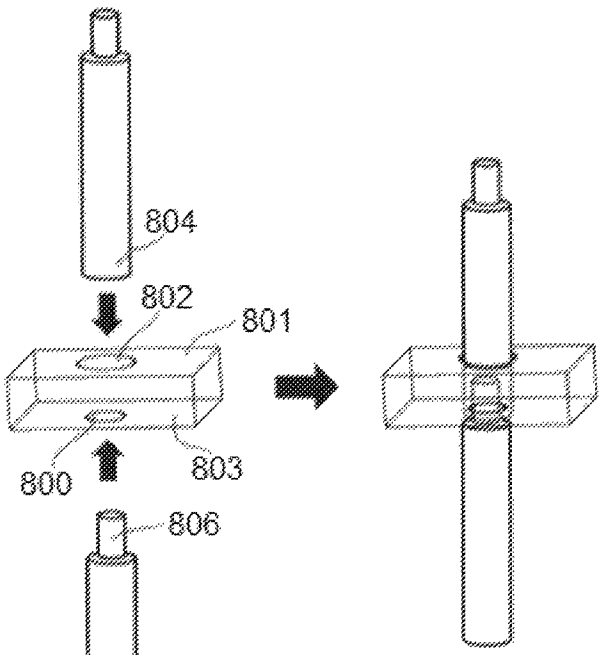
Figure 8A
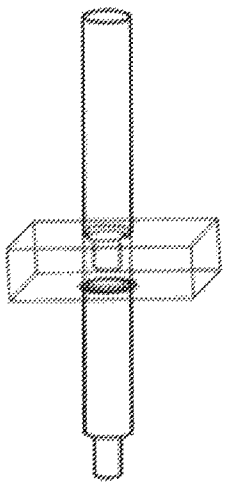
Figure 8B
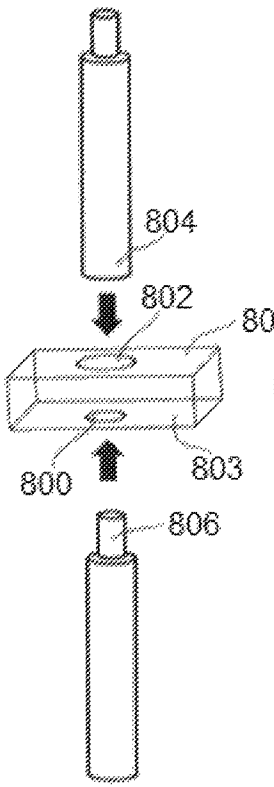
Figure 8C
Figure 8D
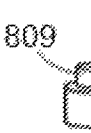
Figure 8E
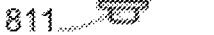
Figure 8F

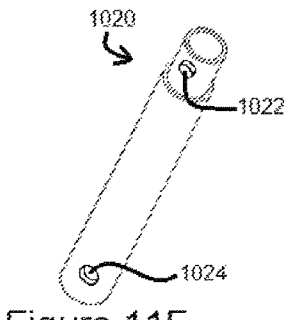
Figure 11A
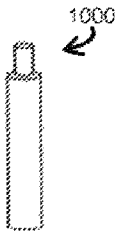
Figure 11B
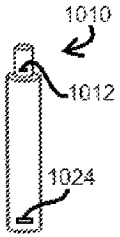
Figure 11C
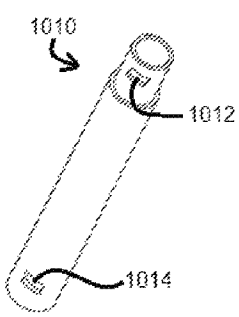
Figure 11D
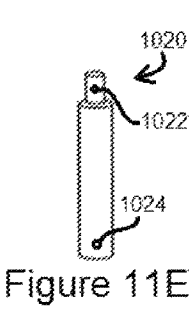
Figure 11E
Figure 11F

MODULAR SHELVING AND STEP ASSEMBLY

CROSS REFERENCE TO RELATED APPLICATIONS

This application claims the benefit of U.S. Provisional Application No. 62/162,773, filed May 17, 2015, the entire contents of which are hereby incorporated by reference in its entirety.

TECHNICAL FIELD

This document generally describes modular systems that can be used as shelving and as steps.

BACKGROUND

Shelving systems have been produced that include adjustable components, such as shelves that can be mounted at any of multiple predefined mounting locations along the height of a shelving system. Shelving systems have also been produced with components that permit them to be readily assembled by users.

SUMMARY

This document generally describes modular systems for use as shelving and steps that can be easily customized to fit a wide array of spaces and to accommodate a variety of needs. For example, rooms in which bunk beds are used, such as dormitories, often have limited free space. The disclosed modular systems can be used to construct a set of steps, customized to the size and layout of a particular room that can be used to climb into the top bunk bed while at the same time providing shelving and storage under the steps of the system.

A variety of modular systems are described in this document. For example, modular systems can include a small group of components that can be assembled into a wide array of shapes, sizes, and configurations. For instance, a modular system can include posts, shelf components, and end caps that can be assembled into a variety of different heights, widths, and depths to accommodate particular spaces and particular intended uses.

In a first general aspect, a modular shelving assembly includes a plurality of shelving components that each include a body, a male portion that extends from a first end of the body, where the male portion has width and height dimensions that are both smaller than width and height dimensions of the body, a female portion that defines a void in a second end of the body that is opposite the first end of the body, where the female portion is sized and shaped to receive the male portion of another shelving component, first apertures defined by and extending through the male portion, and second apertures defined by and extending through the female portion. The modular shelving assembly also includes a plurality of posts that are sized and shaped to be inserted into overlapping apertures of a first shelving component and a second shelving component, the overlapping apertures comprising (i) a first aperture in the male portion of the first shelving component that has been inserted into a female portion of the second shelving component and (ii) a second aperture in the female portion of the second shelving component.

Implementations can include one or more of the following. The plurality of shelving components and posts can be assembled into a plurality of rows, and each of the rows can include one or more of the shelving components. From at least a second row to a top row of the plurality of rows, the number of shelving components can decrease by one shelving component for each successive row from the second row to the top row. The plurality of rows can include steps and shelves. The modular shelving assembly can also include a male end cap that includes a male portion that extends from a first end of the male end cap and that is configured to be inserted into a last shelving component in a row of shelving components with an open female portion, and a female end cap that includes a female portion that defines a void and that is configured to receive a male portion from a first shelving component in a row of shelving components with an open male portion. Each post of the plurality of posts can include a first locking feature near a first end and a second locking feature near a second end, and wherein a first locking feature of a first post of the plurality of posts is configured to engage with a second locking feature of another post of the plurality of posts. The first locking feature can be a tab and the second locking feature can be a groove. The first locking feature can be a protrusion and the second locking feature can be an aperture. The modular shelving assembly can also include one or more lighting members, where the one or more lighting members can be a light strip, a light mat, or a light element sized for an aperture in the body of the shelving component. At least one of the shelving components can include, on an underside of its body, a plurality of post-receiving features, each configured to secure, for storage, a post of the plurality of posts. The modular shelving assembly can also include a panel that includes an attachment feature configured to secure the panel to at least one post of the assembly. The attachment feature can be a hook configured for a compression fit with the post, a curved end configured for a compression fit with the post, or a tab sized to be received by a slit in the post. The male portion can include first and second extensions, and the female portion can include first and second voids. The modular shelving assembly can also include a railing attached to one or more shelving components of the modular assembly. Each component in the plurality of shelving components can have a rectangular shape. Each component in the plurality of shelving components can have a wedge shape. The first apertures can include a top aperture of the male portion and a bottom aperture of the male portion, and the second apertures can include a top aperture of the female portion and a bottom aperture of the female portion, and the top aperture of the male portion and the top aperture of the female portion can each have a first size, and the bottom aperture of the male portion and the bottom aperture of the female portion can each have a second size that is larger than the first size. For at least one post of the plurality of posts, a top portion of the post can be sized larger than a bottom portion of the post. The first apertures can include a top aperture of the male portion and a bottom aperture of the male portion, the second apertures can include a top aperture of the female portion and a bottom aperture of the female portion, and the top aperture of the male portion and the top aperture of the female portion can each have a first size, and the bottom aperture of the male portion and the bottom aperture of the female portion can each have a second size that is smaller than the first size. For at least one post of the plurality of posts, a top portion of the post can be sized smaller than a bottom portion of the post.

In a second general aspect, a modular shelving assembly includes a plurality of shelving components, including a first shelving component having a first length, a second shelving component having a second length that is shorter than the first length, and a third shelving component having a third length that is shorter than the second length, where each of the shelving components defines a plurality of first apertures on a top side of the shelving component and defines a plurality of second apertures on a bottom side of the shelving component, and where each of the second apertures is larger than each of the first apertures. At least one shelving component of the plurality of shelving components includes an upper surface that includes a textured feature. The modular shelving component also includes a plurality of posts, where each post of the plurality of posts includes a top portion of the post that is sized larger than a bottom portion of the post. The plurality of shelving components and posts are assembled into a plurality of rows, where each of the rows includes one of the shelving components, and where from at least a second row of the assembly upward, the included shelving component for a given row is longer than the included shelving component for the row above the given row.

Implementations can include one or more of the following. Each post of the plurality of posts can include a first locking feature on the top portion and a second locking feature on the bottom portion, and the first locking feature of a first post can be configured to engage with the second locking feature of another post.

In a third general aspect, a modular shelving assembly includes a plurality of shelving components, including a first shelving component having a first length, a second shelving component having a second length that is shorter than the first length, and a third shelving component having a third length that is shorter than the second length, where each of the shelving components defines a plurality of first apertures on a top side of the shelving component and defines a plurality of second apertures on a bottom side of the shelving component, and wherein each of the second apertures is smaller than each of the first apertures. At least one shelving component of the plurality of shelving components includes an upper surface that includes a textured feature. The modular shelving component also includes a plurality of posts, where each post of the plurality of posts includes that a top portion of the post that is sized smaller than a bottom portion of the post. The plurality of shelving components and posts are assembled into a plurality of rows, where each of the rows includes one of the shelving components, and where from at least a second row of the assembly upward, the included shelving component for a given row is longer than the included shelving component for the row above the given row.

Implementations can include one or more of the following. Each post of the plurality of posts can include a first locking feature on the top portion and a second locking feature on the bottom portion, and the first locking feature of a first post can be configured to engage with the second locking feature of another post.

The details of one or more implementations are depicted in the associated drawings and the description thereof below. Certain implementations may provide one or more advantages. For example, the disclosed modular systems include modular components that allow for the systems to be readily adapted and customized to virtually any space or location. The set of parts that are used to assemble the modular system is relatively small (e.g., 2 parts, 3, parts, 4 parts), which can permit a basic set of components to be greatly adapted and without having to obtain specialty parts.

In another example, the disclosed modular systems can be securely and quickly assembled without the use of other tools, such as screwdrivers and wrenches. This can permit users will all levels of handiness to effectively use and adapt the modular systems. Additionally, since larger systems can be constructed on site from smaller parts, issues surrounding transporting larger structures through and into tighter spaces (e.g., carrying a large piece of furniture up a stairwell) can be eliminated.

In a further example, materials that are lightweight yet strong (e.g., molded plastics, recycled plastics (e.g., pre- or post-consumer), 3D-printed materials) can be used so as to provide ready portability without sacrificing the quality or structural integrity of the system.

In another example, by having a smaller number of parts, efficiencies in production can be gained by having to set up fewer production runs. For instance, if injection molding is being used to produce the parts of the modular system, the disclosed modular system can allow for price savings by using fewer molds.

In another example, the systems can be shipped and stored easily and efficiently, for example because the components can be housed within an underside of the shelf, which can reduce transportation and stocking costs in some examples.

Other features, objects, and advantages of the technology described in this document will be apparent from the description and the drawings, and from the claims.

BRIEF DESCRIPTION OF THE DRAWINGS

FIGS. 8A-D depict example sizing of apertures and posts.

FIG. 8E is a perspective view of an example base element that can be used with an example modular system.

FIG. 8F is a perspective view of an example cap that can be used with an example modular system.

FIGS. 11A and 11B are side and perspective views, respectfully, of an example post.

FIGS. 11C, 11D, 11E, and 11F are views of example posts that include a locking feature.

Like reference symbols in the various drawings indicate like elements.

DETAILED DESCRIPTION

Figures 1A, 1B, 1C, 1D:
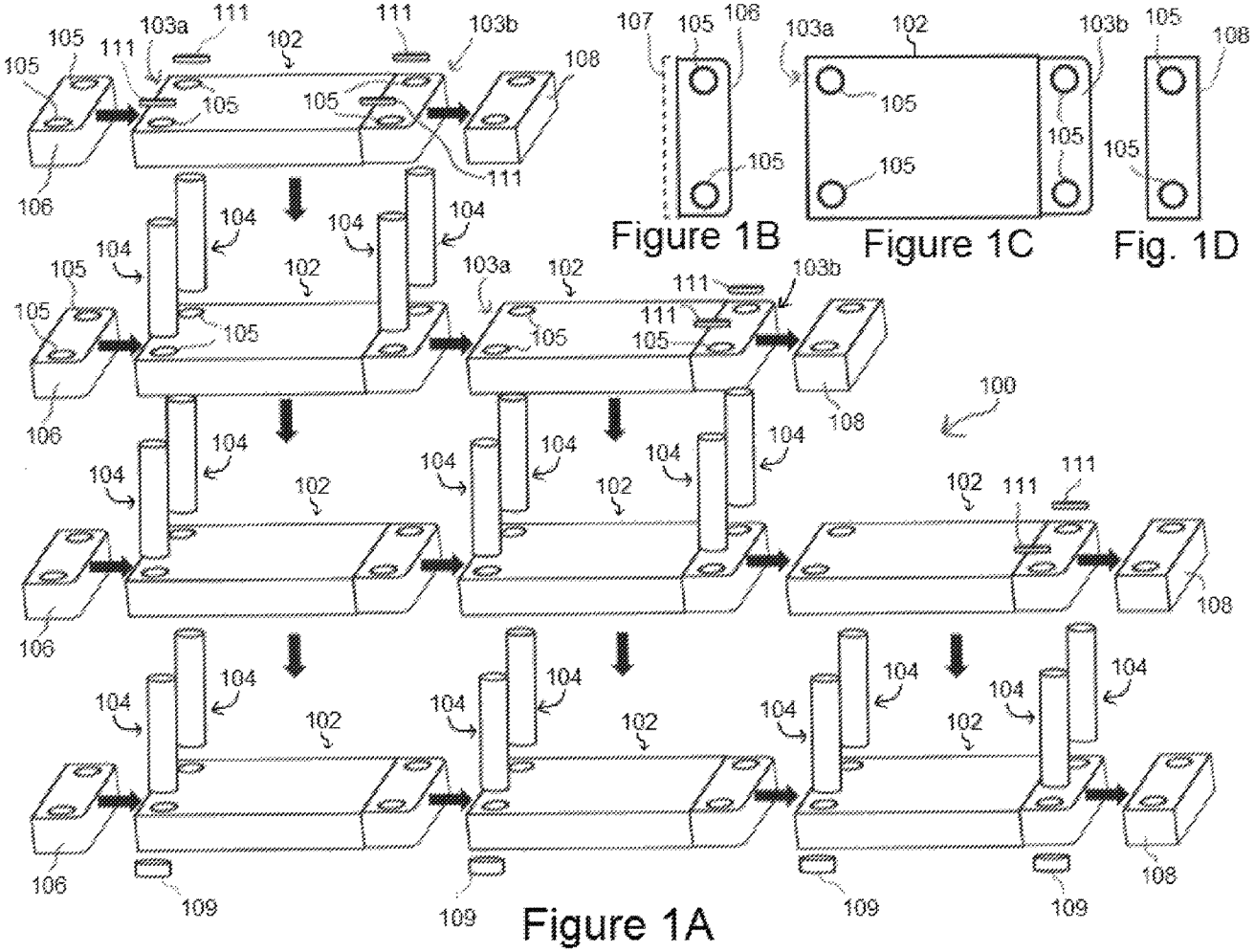
FIGS. 1A-H depict views of an example modular system with interlocking shelf components, posts, male end caps, and female end caps.

FIGS. 1A, 1B, 1C, 1D, 1E, and 1H depict views of an example modular system 100 with interlocking shelf components 102, posts 104, male end caps 106, and female end caps 108.

Referring to FIG. 1A, which depicts an assembly for the system 100, the shelf components 102 has a female end 103*a* that includes a void that extends inwardly from the end and that is defined by interior sidewalls of the components 102. The void in female end 103*a* is sized and shaped to receive male ends 103*b* of the components 102 (e.g., a male end 103*b* of another shelf component 102). The male ends 103*b* are sized and shaped to be smaller in their width and height than the main body of the components 102, which can permit the male ends 103*b* to be inserted into the void in the female end 103*a* (e.g., into the void in the female end 103*a* of another shelf component 102).

The components 102 additionally include apertures 105 that are defined by openings in the top and bottom surfaces of the components 102, and that extend through the height of the components 102. The apertures 105 can be sized and shaped to fit the posts 104, which can be received by the apertures 105. As depicted in the example system 100, the apertures 105 are positioned at or near the ends 103*a*, 103*b* of the components 102. The positioning of the apertures 105 in these locations at or near the ends 103*a*, 103*b* permits for the components 102 to be secured to each other by merely inserting the posts 104 through the overlapping apertures 105 of a male end 103*b* and a female end 103*a* after the male end 103*b* has been inserted into the female end 103*a* of a component 102, in some implementations. With such a configuration, a user may not need any tools (e.g., screw driver, wrench) to assemble the system 100 into any of a variety of configurations.

The male end caps 106 can be shaped and sized similarly to the male ends 103*b* of the components 102, and can be inserted into a last component 102 with an exposed female end 103*a* on each row of the assembly. The male end caps 106 can also include apertures 105 and can be secured to the appropriate components 102 by being first inserted into the female end 103*a* of the components 102 and then by posts 104 being inserted and through the overlapping apertures 105 of the components 102 and the end caps 106. The end caps 106 can provide a variety of benefits, including improving the structural integrity and strength of the system 100 and covering potentially sharp or otherwise dangerous portions of the exposed female ends 103*a*.

Referring to FIG. 1B, which depicts an overhead view of an example male end cap 106, the male end caps 106 can optionally include a rear portion 107 that has height and width dimensions that are the same as or similar to the body of the components 102. Such a rear portion 107 may extend beyond the end 103*a* of the components 102 and, when the end cap 106 is inserted into the end 103*a*, could define a surface that extends along the same planar surface as the top surface of the components 102.

Like the male end caps 106, the example female end caps 108 can be used to cover an exposed male end 103*b* of the first component 102 on each row of the system 100. The female end caps 108 can define voids that are similar in size and shape to the voids defined in the female ends 103*a* of the components 102 so as to permit receipt of the male ends 103*b* of the components 102. Referring to FIG. 1D, which depicts an overhead view of an example female end cap 108, the apertures 105 extend through the end cap 108. This configuration may permit the end caps 108 to be secured to the components 102 by the posts 104 being inserted into the overlapping apertures 105 of the male ends 103*b* and the end caps 108 after the male end 103*b* has been inserted into the void of the end cap 108.

The end caps 108 can have width and height dimensions that are the same as or similar to the main body of the components 102 so that, when the end caps 108 are secured to the components 102, together they form nearly contiguous external surfaces. Like the end caps 106, use of the end caps 108 can provide a variety of benefits, including increasing the structural integrity and strength of the system and reducing a risk of injury from the lip formed at the transition from the male end 103*b* to the main body of the components 102.

Referring to FIG. 1C, which depicts an overhead view of an example interlocking shelf component 102, the width of the male end 103*b* of the component 102 may be smaller than the width of the main body of the component 102.

As indicated in the assembly depicted in FIG. 1A, the system 100 can be configured in any of a variety of ways. In the depicted example, the assembly includes four rows of interlocking shelf components 102, with the first and second rows (moving from the bottom row to the top row) each including three interlocking components 102, the third row including two interlocking components 102, and the fourth (top) row including only one component 102.

Optionally, the system 100 can include base elements 109, where an upper portion of the base element 109 can be received in an aperture 105 on the underside (not shown in FIG. 1A) of the components 102 in the first row of the system 100. Examples system 100 that include base elements 109 would include eight base elements 109, but for simplicity only four base elements 109 are shown in FIG. 1A. Also optionally, the system can include caps 111, where a lower portion of the cap 111 that can be received in an aperture 105 on the top-side of the components 102 in the top row (the fourth row in this example) of the system 100.

Figures 1E, 1F, 1G, 1H:
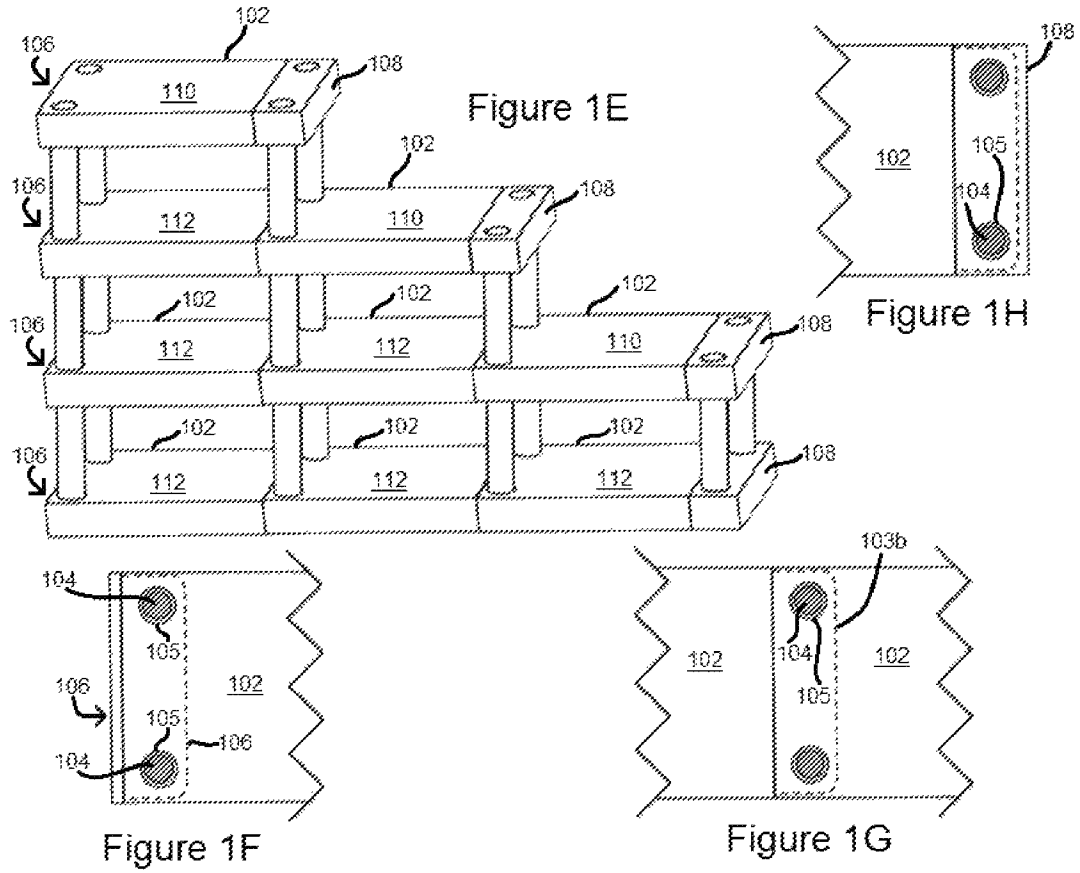

Referring to FIG. 1E, which depicts the assembled system 100, the second, third, and fourth rows each end up with one of the components 102 having a top surface 110 that is exposed (not covered above by another component 102). These exposed top surfaces can be used for a variety of purposes, including as steps. In some examples, the top surfaces 110 include a non-slip surface. In some examples, the top surfaces 110 include texturing. The top surfaces 112 of the other components 102 that are covered (not exposed) can be used for a variety of purposes, such as shelves and for storage. The example system 100 of FIG. 1E does not include base elements 109 or caps 111, for example.

FIG. 1F depicts a top view of an end cap 106 being secured to a component 102 by insertion of posts 104 into the overlapping apertures 105 of the end cap 106 and the female end 103*a* of the component 102. Such relationships between the end cap 106, the component 102, and the posts 104 are used with the leftmost components 102 on each row of the assembled system 100 depicted in FIG. 1E.

FIG. 1G depicts a top view of two shelving components 102 being secured to each other by insertion of posts 104 into the overlapping apertures 105 of the male end 103*b* of the component 102 depicted on the left and the female end 103*a* of the component 102 depicted on the right. Such relationships between two components 102 and the posts 104 are used in the connections between the adjacent components 102 on each row of the assembled system 100 depicted in FIG. 1E.

FIG. 1H depicts a top view of an end cap 108 being secured to a component 102 by insertion of posts 104 into the overlapping apertures 105 of the end cap 108 and the male end 103*b* of the component 102. Such relationships between the end cap 108, the component 102, and the posts 104 can be used with the rightmost components 102 on each row of the assembled system 100 depicted in FIG. 1E.

Although a particular assembled configuration of the system 100 is depicted in FIGS. 1A and 1E, other configurations can also be assembled using the components 102, the posts 104, and the end caps 106, 108. For example, a square or rectangular arrangement of shelves could be constructed. In another example, a pyramid of shelves could be constructed (e.g., with steps approaching a center of the system from the left and the right). Other configurations are also possible.

The components 102, the posts 104, end caps 106 and 108, base elements 109, and caps 111 can have any of a variety of appropriate shapes and dimensions. For example, the height of the posts 104 can be selected so that the rise between rows is suitable for use of the system 100 as steps. In another example, the posts 104 can have cross-sections with any of a variety of shapes, such as circular shapes (as depicted), square shapes, rectangular shapes, triangular shapes, symmetric shapes, asymmetric shapes, and/or other appropriate shapes. In another example, the width and length of the step components 102 can be selected so that the surface of the components 102 is sufficiently large for users to comfortably and safely stand thereon. In some examples, the components 102 may have a length of about 12", and a width of about 12", although other appropriate lengths and/or widths (e.g., length 15"×15", 15"×12", 12"×10", 10"×10", 20"×15", combinations of the foregoing, and others) can be used. In some examples, the posts 104 may be sized to provide a rise of about 10" between steps, but in other examples the posts 104 can be sized to provide alternative amounts of rise (e.g., 7", 8", 9", 11", 12", 13", 14", and others).

As with the other modular systems described throughout this document, the system 100 and its component parts can be made out of any of a variety of appropriate materials so that the system 100 is able to safely support an intended load, such as a user standing on one or more of the exposed surfaces 110 of the assembled system 100. For example, the parts 102-108 of the system 100 can be made out of any of a variety of appropriate polymers (e.g., molded plastics, recycled plastics (e.g., pre- and post-consumer)), metals (e.g., aluminum, titanium, steel), composite materials (e.g., carbon fiber-based materials, glass fiber-based materials), 3D-printed materials, and/or other appropriate materials. In some examples, the components 102 can have a generally continuous top surface (e.g., as depicted in FIGS. 1A and 1E). In some examples, the components 102 can include vents, ribs, or apertures to reduce an amount of material used.

Figure 2B:
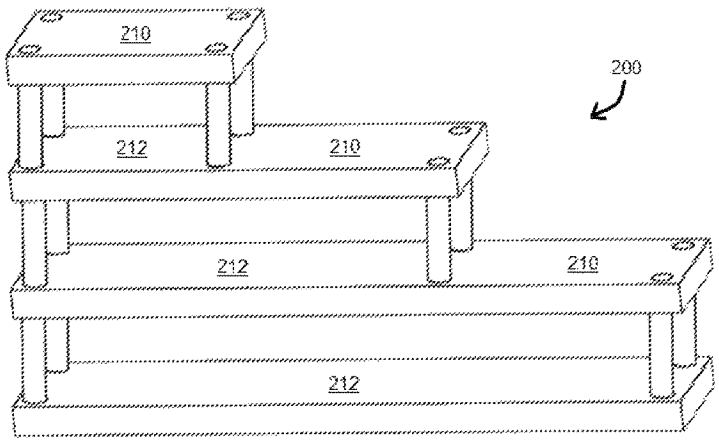
FIGS. 2A-B depict an example modular system with fixed length shelving components.
Figure 2A:
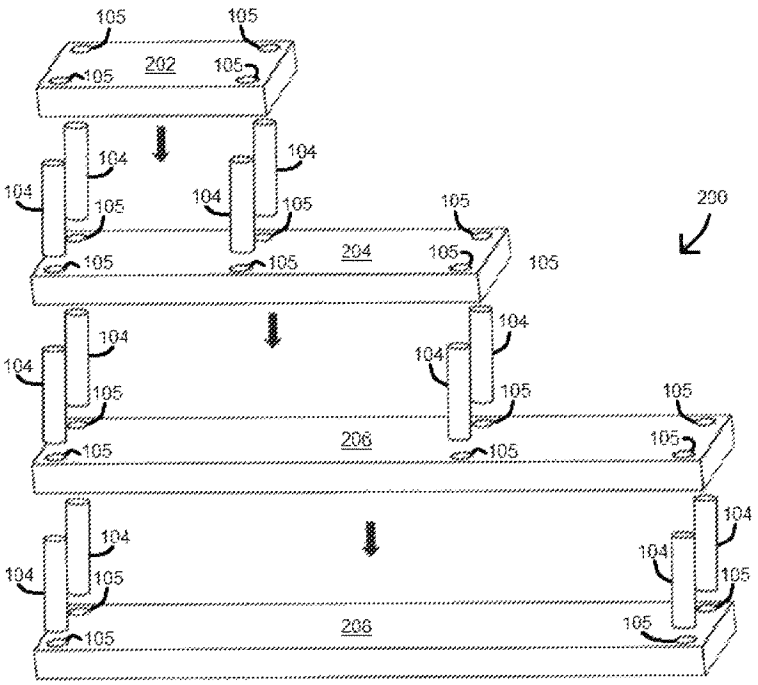

FIGS. 2A and 2B depict an example modular system 200 with fixed length shelving components 202, 204, 206, and 208 and posts 104. Referring to FIG. 2A, an assembly of the system 200 is depicted in which four shelving components 202, 204, 206, 208 are assembled into a structure similar to the system 100. However, the components 202, 204, 206, 208 are different from the components 102 in that the components 202, 204, 206, 208 are of specific lengths and are not specifically configured to be interlocked end to end with other shelving components to form longer contiguous shelf lengths. As indicated, the component 202 is the shortest of the shelves, the component 204 is the next longest, and the components 206, 208 are the longest shelves. Each of the components 202-208 includes multiple apertures 105 into which the posts 104 can be inserted to assemble the system 200. Example positions for the apertures 105 are depicted in FIG. 2A. In some examples, the system 200 includes base elements 109 and/or caps 111 (not shown in FIG. 2A).

Referring to FIG. 2B, the assembled system 200 has an overall appearance similar to the assembled system 100 depicted above in FIG. 1E and could, for example, be used for storage and for steps. For instance, the system 200 includes exposed top surfaces 210 that can be used as steps and covered top surfaces 212 that can be used as shelves and for storage. The top surfaces 212 of the system 200 can be larger than the top surfaces 112 of the system 100 based on fewer internal posts 104 being used in the assembly of the system 200. In some examples, surfaces 210 include a non-slip surface or a texture, for example. In other examples, additional posts 104 and corresponding apertures 105 can be used to provide systems with additional support between the levels of the system.

FIGS. 3A, 3B, 3C, 3D, 3E, and 3F depict example assembly 300 of two modular systems 302*a* and 302*b*, side-by-side. In the depicted example, the modular systems 302*a*, 302*b* are similar to the modular system 100. However, the modular systems 302*a* and 302*b* can be any of a variety of appropriate modular systems, such as the modular system 200, a combination of different types of modular systems, and/or other appropriate modular systems.

Figure 3C:
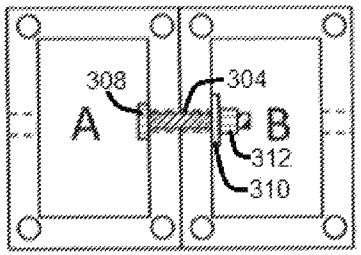
FIGS. 3A-F depict an example assembly of two modular systems side-by-side.
Figure 3D:
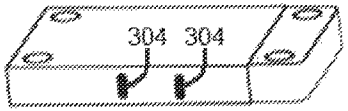
Figure 3B:
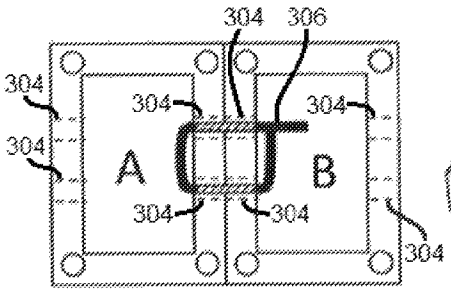
Figure 3E:
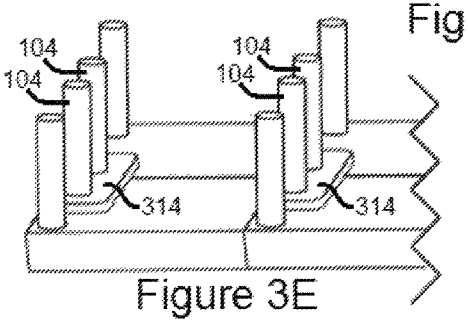
Figure 3F:
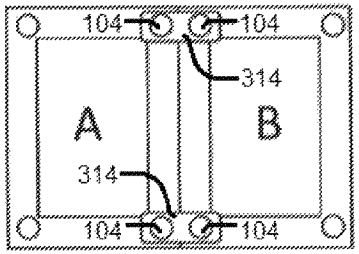
Figure 3A:
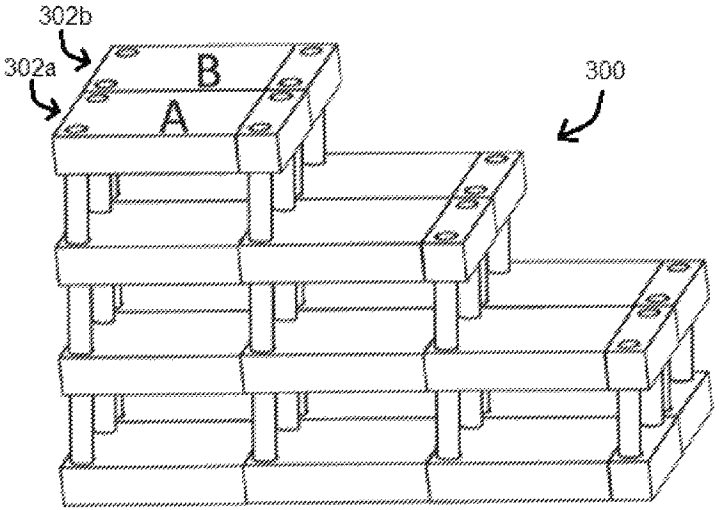

Referring to FIG. 3A, the assembly 300 includes a first modular system 302*a* and a second modular system 302*b* that are affixed to each other along their length so as to form a wider system (e.g., double the width of earlier-described systems). Any of a variety of appropriate mechanisms can be used to affix the systems 302*a* and 302*b* to each other, such as the examples depicted in FIGS. 3B, 3C, 3D, 3E, and 3F.

Referring to FIGS. 3B, 3C, and 3D, the shelf components (e.g., shelf components 102, shelf components 202-208) can include one or more apertures 304 that are defined and extend through the sidewalls of the shelf components. For instance, referring to FIG. 3D, an example component is depicted as including two apertures 304 through its sidewall. These sidewall apertures 304 can be lined up with each other across the systems 302*a* and 302*b* so that a fastening mechanism can be used to secure the systems 302*a* and 302*b* together. Example fastening mechanisms are depicted in FIGS. 3B and 3C.

For example, FIG. 3B depicts a bottom view of an example fastening mechanism 306 (e.g., zip tie, cable tie, rope, chain, string, elastic) being passed through the aligned apertures 304 of component A and B, and secured against itself (e.g., zip tie locking mechanism, knot). Alternatively (and/or additionally), the fastening mechanism 306 can be secured against an element of one or more of the components A and B, such as a cleat that is affixed to the bottom side of one or more of the components A and/or B.

In another example, FIG. 3C depicts a bottom view of a bolt 308 passing through an aligned single aperture 304 in the side walls of components A and B, and the bolt being secured by a washer 310 (e.g., locking washer) and a nut 312.

Referring to FIGS. 3E and 3F, other mechanisms for securing the systems 302*a* and 302*b* to each other are also possible. For example, adjacent and aligned posts 104 from the systems 302*a* and 302*b* can be secured to each other through the use of a fasteners 314 that loop around each of the adjacent posts 104. The fasteners 314 can be secured along the posts 104 when shelving components are connected to the ends of the posts 104 above and below the fasteners 314, for example. The fasteners 314 can be any of a variety of appropriate mechanisms, such as straps, cables, elastic bands, rubber bands, appropriately formed and rigid materials (e.g., metals, polymers), and/or other appropriate mechanisms.

FIG. 3E depicts a perspective view of the fasteners 314 being looped around the posts 104 to secure the systems 302*a* and 302*b* together. FIG. 3F depicts a bottom view of the fasteners 314 being looped around the posts 104 to secure the systems 302*a* and 302*b* together.

In some examples, the shelf components of the systems (e.g., shelf components 102, shelf components 202-208) of the systems 302*a* and 302*b* can include mating or interlocking features on the sidewalls of the shelf components such that a first interlocking feature on a shelf component of system 302*a* can engage with a second interlocking feature on a shelf component of system 302*b* and secure system 302*a* to system 302*b*.

FIGS. 4A, 4B, 4C, 4D, and 4E depict an example assembly 400 of an example modular system 402 being secured to another structure 404. Such a structure 404 can be any of a variety of structures adjacent to which the modular system 402 can be placed, such as a bed frame, a bunk bed frame, a wall, a dresser, a desk, and/or other appropriate structures. In the depicted example, the modular system 402 is similar to the modular system 100. However, the modular system 402 can be any of a variety of appropriate modular systems, such as the modular system 200, a combination of different types of modular systems, and/or other appropriate modular systems.

Figures 4A, 4B, 4C, 4D, 4E:
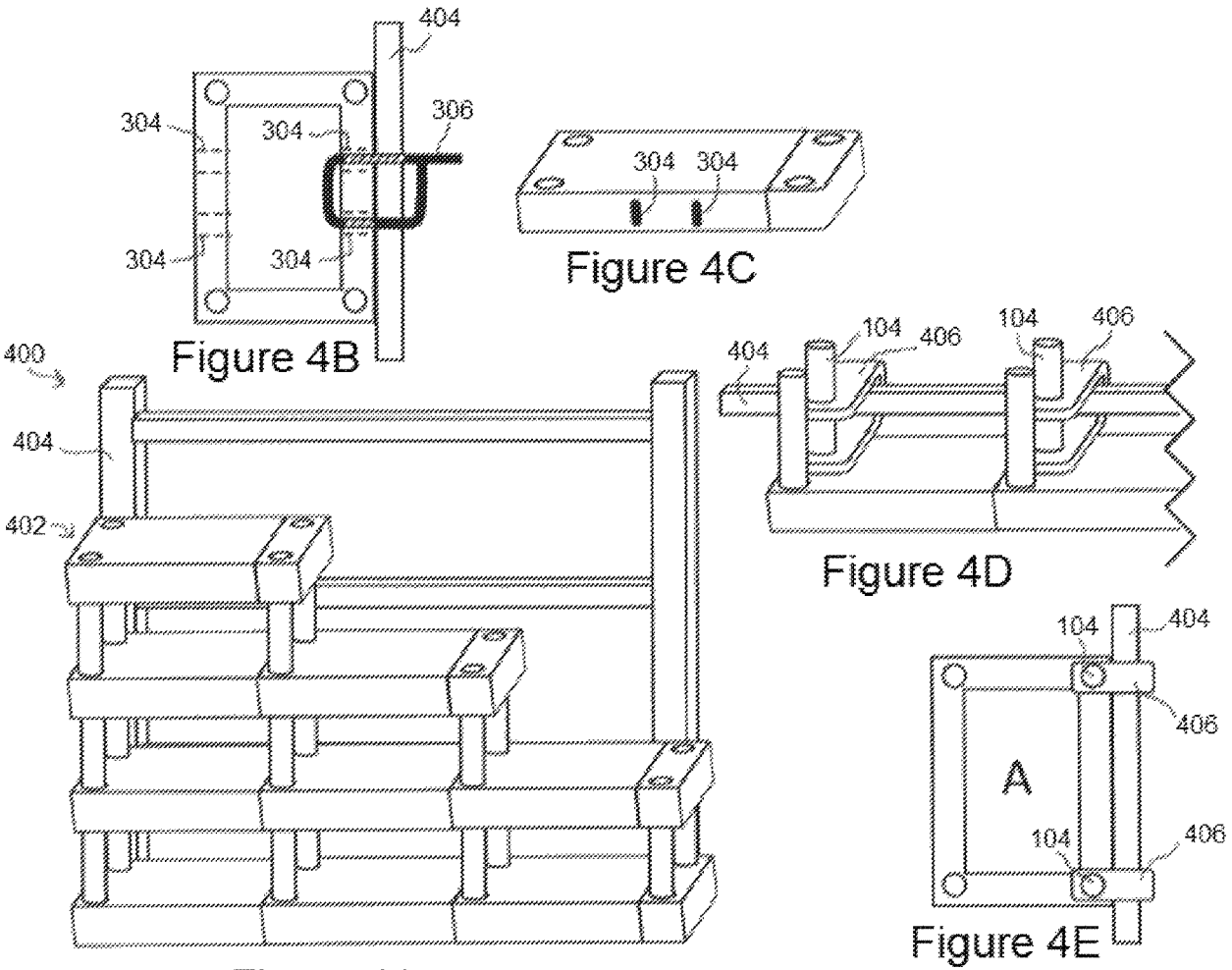
FIGS. 4A-E depict views of an example assembly of an example modular system being secured to another structure.

Any of a variety of appropriate mechanisms can be used to affix the system 402 to the structure 404, such as the examples depicted in FIGS. 4B, 4C, 4D, and 4E. Referring to FIGS. 4B and 4C, the shelf components (e.g., shelf components 102, shelf components 202-208) can include one or more apertures 304 that are defined and extend through the sidewalls of the shelf components. For instance, referring to FIG. 4C, an example component is depicted as including two apertures 304 through its sidewall. These sidewall apertures 304 can be lined up with an appropriate portion of the structure 404 (e.g., portion of the structure 404 around which a flexible tether can be looped) so that a fastening mechanism can be used to secure the system 402 and the structure 404 together.

An example fastening mechanism 306 is depicted in FIG. 4B. For example, FIG. 4B depicts a bottom view of example fastening mechanism 306 (e.g., zip tie, cable tie, rope, chain, string, elastic) being passed through the apertures 304 of the component, wrapped around a portion of the structure 404, and secured against itself (e.g., zip tie locking mechanism, knot). Alternatively (and/or additionally), the fastening mechanism 306 can be secured against an element of one or more of the component (e.g., against a cleat that is affixed to the bottom side of the component) or the structure 404.

Referring to FIGS. 4D and 4E, other mechanisms to fasten the system 402 to the structure 404 are also possible. For example, fasteners 406 can be, at one end, looped around the post 104, wrapped around a portion of the structure 404, and then at the other end looped around the post 104 again. The fasteners 406 can be secured in this position by connecting shelving components to either end of the post 104 to which the fastener 406 is secured. The fasteners 406 can be any of a variety of appropriate mechanisms, such as straps, cables, elastic bands, rubber bands, appropriately formed and rigid materials (e.g., metals, polymers), and/or other appropriate mechanisms.

FIG. 4D depicts a perspective view of the fasteners 406 being used to secure the system 402 to the structure 404. FIG. 4E depicts a bottom view of the fasteners 406 being used to secure the system 402 to the structure 404. The fasteners 406 have a "U" shape, and include apertures through which a post 104 can pass.

FIGS. 5A, 5B, 5C, 5D, 5E, and 5H depict example panels that can be incorporated into modular systems. Panels can be fitted between posts and shelving components, and can be used to provide sidewalls with the shelving portions of the modular systems described throughout this document.

Figures 5A, 5B, 5C, 5D, 5E, 5F, 5G, 5H, 5I:
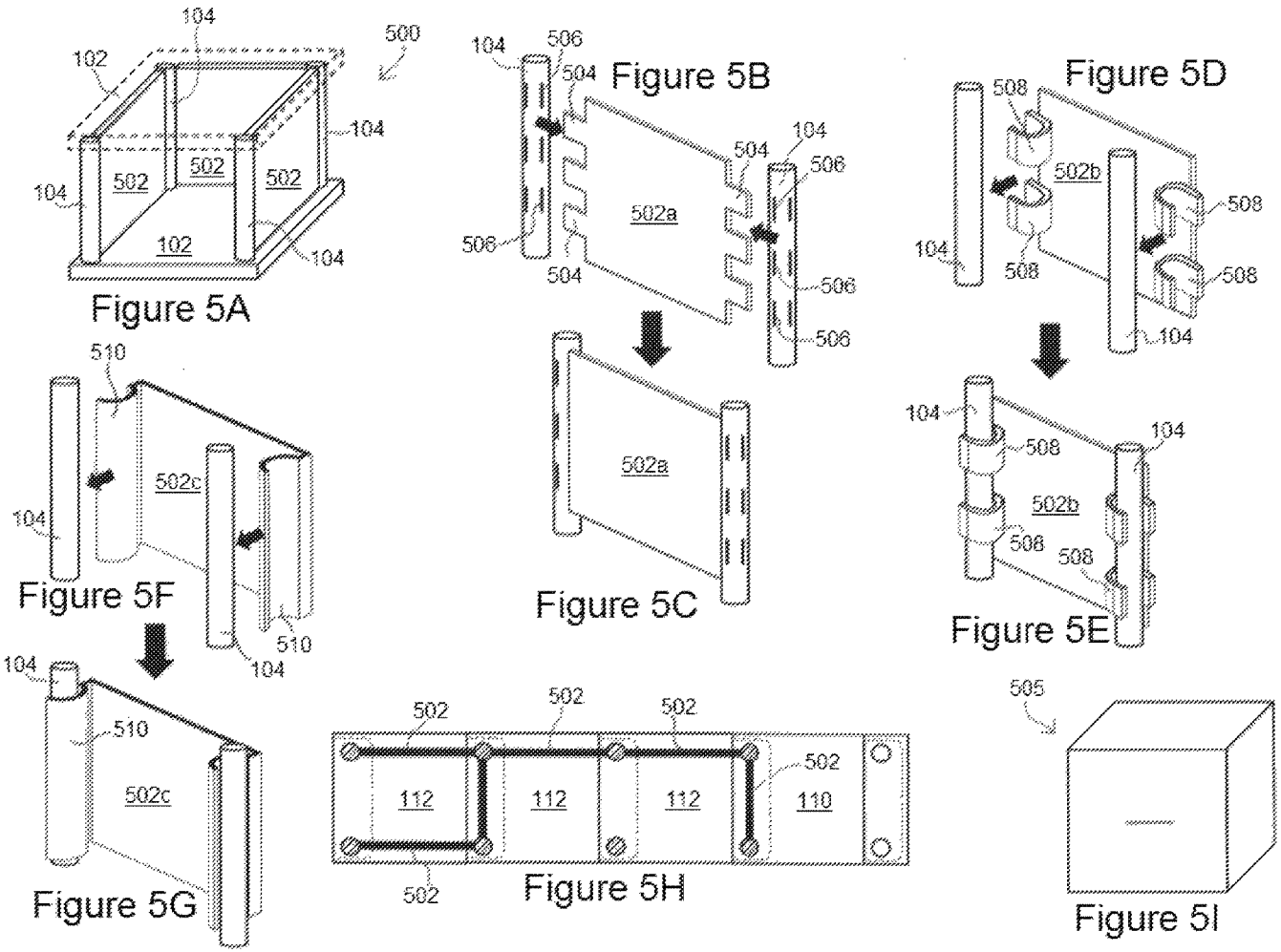
FIGS. 5A-H depict example panels that can be incorporated into modular systems.
FIG. 5I depicts an example drawer that can be used with modular systems.

Referring to FIG. 5A, a portion of a modular system 500 is depicted as including example panels 502 that are fitted along three sides of the space defined by the posts 104 and the top and bottom shelf components 102. As depicted, the placement of the three panels 502 allows for a user to store items within the defined shelf/storage area without risk of the items falling out of the sides or the back of the shelf/storage area.

A variety of mechanisms can be used to fit and secure the panels 502 at appropriate locations. For example, referring to FIGS. 5B and 5C, a first example of the panels 502*a* can include one or more tabs 504 that are appropriately sized and spaced along the lateral edges of the panels 502*a* so as to line up with and be inserted into slits/apertures 506 running lengthwise along the posts 104 (for examples that do not include tabbed panels 502*a*, the posts 104 may not include slits 506). In another example, referring to FIGS. 5D and 5E, a second example of the panels 502*b* can include affixed hooks 508 that are appropriately positioned along the panels 502*b*, sized, and curved so as to form a compression fit between the posts 104. In a further example, referring to FIGS. 5F and 5G, a third example of the panels 502*c* can include curved ends 510 that are sized and shaped so as to form a compression fit between the posts 104. In some examples, the panels 502 can be extruded with concave edges configured to accept the posts 104, for example.

Although not depicted, the panels 502 and attachment mechanisms may additionally and/or alternatively include additional features, such as, for example, hinges, handles, and/or other appropriate attachment mechanisms. The example of FIG. 5A shows side edges of the panels 502 intersecting with the posts 104. In other examples, the side edges of a panel 502 may intersect at roughly 90 degree angles with the side edges of another panel 502, as by varying position of the slits/apertures 506, or by varying position (or other characteristic) of the hooks 508 or curved ends 510, for example.

FIG. 5H depicts a top view of an example configuration of panels 502 along a row of an example system that includes four shelf components, three of which are covered (112) by other shelf components above them and one of which is exposed (110) (e.g., not covered from above by a shelf component). In this example, the panels 502 create a 2×1 storage compartment in the middle of the row that is accessible from the side and a 1×1 storage compartment at the left end of the row that is accessible from the end. The other end of the row includes an exposed surface, which could be used as a step, for example. Other configurations are possible (e.g., three 1×1 storage compartments, a 3×1 storage compartment, a 2×1 storage compartment to the left of a 1×1 storage compartment), for example, by providing different arrangements of the panels 502.

FIG. 5I depicts an example drawer 505 that can be used in some examples to fit within a 1×1 storage space defined by four posts 104, for example. In examples where drawer 505 is used, panels 502 may or may not be used. In other examples, drawer 505 can have different sizes, including wider sizes to accommodate a 2×1 storage compartment, a 3×1 storage compartment, or a 4×1 storage compartment, for example.

Figure 6B:
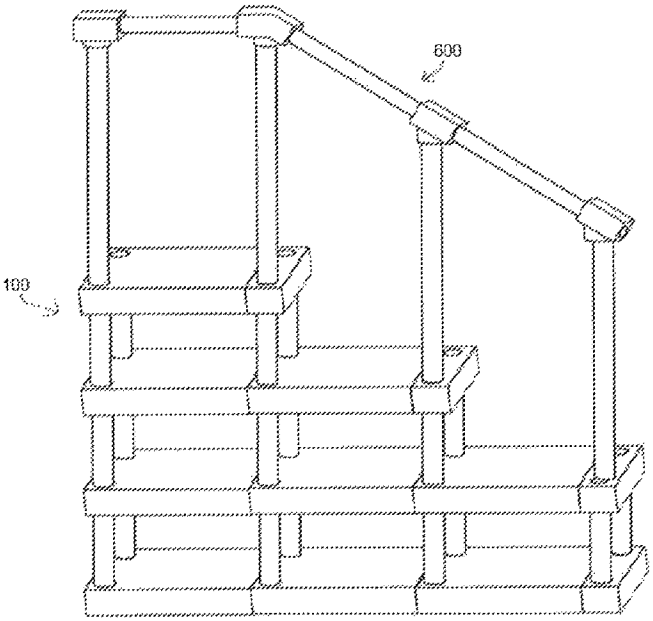
FIG. 6B depicts an example modular system and an example railing system.
Figure 6A:
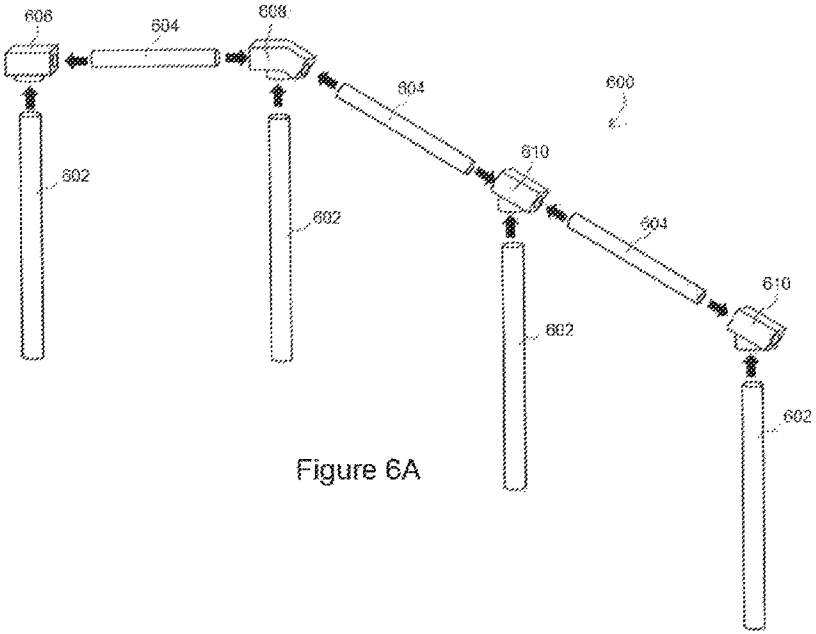
FIG. 6A depicts an example railing system that can be added to modular systems.

FIGS. 6A and 6B depict an example railing system 600 that can be added to modular systems, such as the modular systems 100, 200, 300, and/or other appropriate modular systems. The railing system 600 can use posts 602 that are similar to (e.g., but longer than) the posts 104 and that can be inserted into apertures 105 in the exposed top surfaces 110 of shelf components.

Referring to FIG. 6A, an assembly for the railing system 600 is depicted. The system 600 includes posts 602 that are secured to the underlying modular system, railings 604, and connectors 606, 608, and 610 that connect the posts 602 and the railings 604 together. The connectors 606, 608, and 610 can be appropriately angled and sized to fit the posts 602 and the railings 604 at various points along the progression of an underlying modular system. For example, three different types of connectors 606, 608, and 610 are depicted—a right angle connector (606), a combination right and angled connector (608), and an angled connector (610).

Referring to FIG. 6B, the assembled railing system 600 is depicted as being attached to the example modular system 100. The railing system 600 can be used with other modular system as well, such as the modular system 200. Although only one railing is depicted, more than one railing can be used with each modular system. For example, a second railing could be attached on the other side of the modular system 100.

FIGS. 7A, 7B, 7C, 7D, 7E, and 7F depict an example circular or spiral modular system 700. The modular system 700 that is depicted is similar to the modular system 100, but it includes wedge shaped shelf components 702 with a female side 703 (similar to the female end 103*a* of component 102) and a male side 704 (similar to the male end 103*b* of component 102) that, when combined, provide a circular/spiral effect. For example, referring to FIG. 7A, an example system 700 with four rows of wedge-shaped components 702 has the effect of a spiral staircase, but with accessible storage/shelving underneath the stairs, where the storage areas have generally wedge shapes.

Figure 7A:
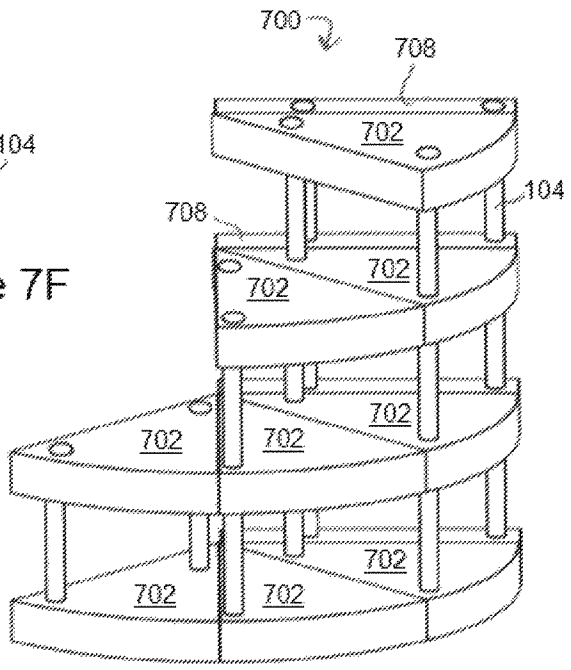
FIGS. 7A-F depict an example circular/spiral modular system.
Figure 7F:
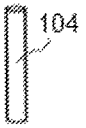
Figure 7E:
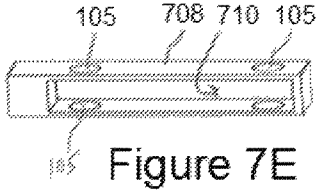
Figure 7B:
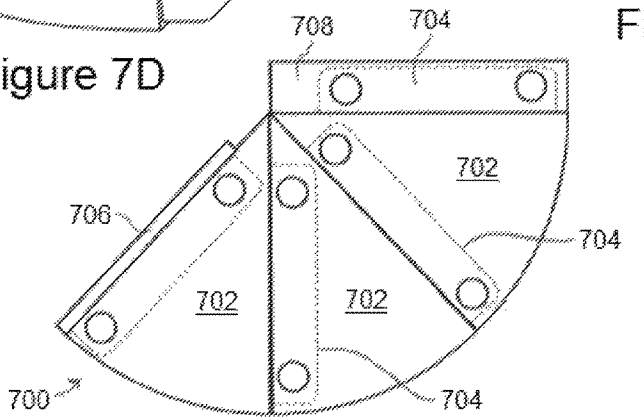

Referring to FIG. 7B, which depicts a top view of the bottom row of the system 700, the interlocking features of the system 100 are included with the wedge-shaped components 702. For example, the male sides 704 of the components 702 are inserted into the female sides 703 of adjacent components 702 or (e.g., for the right-most component 702) into a female end cap 708, which includes a recess 710 to receive the male side 704. Additionally, a male end cap 706 can be inserted into the female side 703 of the left-most component 702. As described above with regard to the system 100, insertion of the posts 104 secures the components 702 and the end caps 706, 708 to each other without the need for any tools.

Figure 7C:
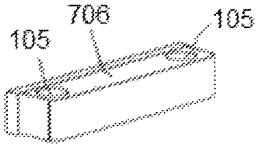
Figure 7D:
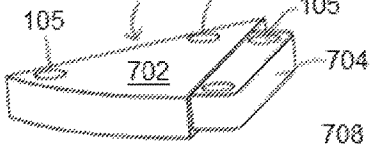

FIG. 7C depicts a perspective view of an example male end cap 706. FIG. 7D depicts a perspective view of an example wedge-shaped component 702. FIG. 7E depicts a perspective view of an example female end cap 708. FIG. 7F depicts a perspective view of an example post 104.

Although not depicted, the system 700 can additionally and/or alternatively use fixed-length wedge-shaped components, similar to the fixed-length shelf components described above with regard to the system 200. Also, in some examples, system 700 can use base elements 109 or caps 111 (not shown in FIG. 7A). In some examples, the wedge components acting as step in the system 700 can include a non-slip or textured surface.

FIGS. 8A, 8B, 8C, and 8D depict example sizing of apertures and posts. To ensure that vertically stacked/connected posts appropriately line-up with each other while also securing the shelving components in fixed vertical positions, appropriate sizing of the posts and apertures may be used.

FIGS. 8A and 8B depict a first example in which a shelf component includes an aperture 800 in the top surface 801 of the component that is smaller than an aperture 802 in the bottom surface 803 of the component, a bottom post that includes a wider diameter portion 804 that will be inserted into the aperture 802 and that will vertically support an interior surface of the top surface 801 of the component (the portion 804 will not pass through the aperture 800), and a top post that includes a more narrow diameter portion 806 that will be inserted into aperture 800 and inside of a hollow portion of the portion 804 of the bottom post, in this example. FIG. 8A depicts the posts prior to insertion and FIG. 8B depicts the posts as inserted into the component.

FIGS. 8C and 8D depict a second example that is the inverse of the example in FIGS. 8A and 8B. In particular, the second example includes an aperture 800 in the bottom surface 803 of the component that is smaller than an aperture 802 in the top surface 801 of the component, a top post that includes a wider diameter portion 804 that will be inserted into the aperture 802 and that will vertically rest on an interior surface of the bottom surface 803 of the component (the portion 804 will not pass through the aperture 800), and a bottom post that includes a more narrow diameter portion 806 that will be inserted into aperture 800 and inside of a hollow portion of the portion 804 of the top post, in this example. FIG. 8C depicts the posts prior to insertion and FIG. 8D depicts the posts as inserted into the component.

FIG. 8E depicts an example base element 808, which may be the same as or similar to the base element 109 of FIG. 1A. Base element 808 includes a narrower diameter portion 809 that may be inserted from the bottom into an aperture on the bottom side of a first-row shelf component, for example. In some examples, the base element can include a downward-facing spike for better engagement with the surface on which the assembly is located (e.g., carpet or other generally soft surface for indoor applications, grass/dirt/gravel for outdoor applications). FIG. 8F depicts an example cap 810, which may be the same as or similar to the cap 111 of FIG. 1A. Cap 810 includes a narrower diameter portion 811 that may be inserted from the top into an aperture on the upper side of a top-row shelf component, for example.

In some examples, one or more fasteners (e.g., screws, clips, snaps, pins, plugs, tabs, locking tabs, compression-fit fasteners, or other fasteners) may secure components of a system together, such that lifting a top-shelf component of the system causes the entire system to lift rather than breaking apart, for example.

Figure 9:
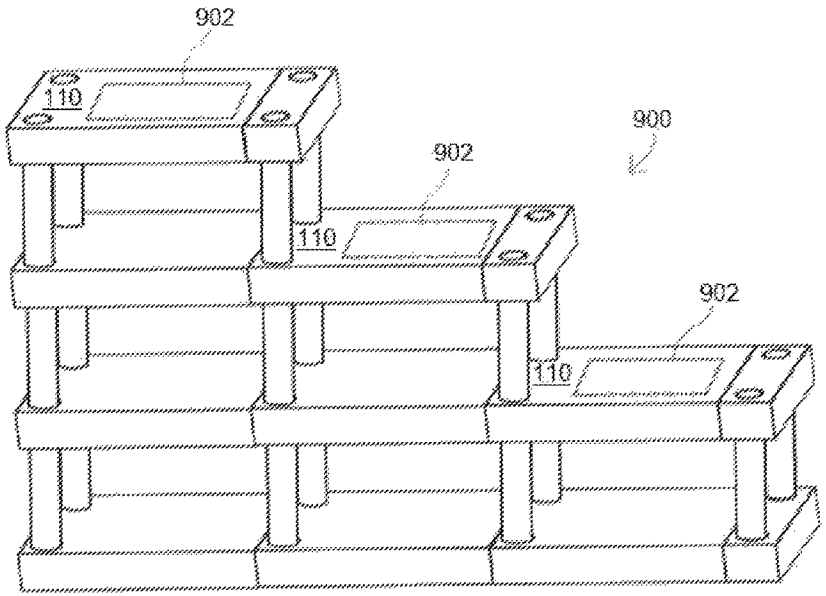
FIG. 9 depicts a perspective view of another example modular system.

FIG. 9 depicts an example system 900. System 900 is similar to system 100 of FIG. 1E, but additionally includes one or more lighting assemblies 902. In the depicted example, the lighting assemblies 902 are shown on the top surfaces 110 of shelf components that are exposed and can serve as steps for the system 900. In some examples, the lighting assemblies 902 are one or more light strips, and can be arranged in any appropriate pattern on the top surfaces 110. In some examples, the light strips can include generally flexible strips that include one or more LED lights that can provide illumination. In some examples, the lighting assemblies 902 may be lighting mats. The lighting assemblies 902 may be secured to the top surfaces 110 of the shelf components. In some examples a portion or all of the lighting assemblies 902 may be positioned on sidewalls of the shelf components (not shown). In some examples, the illumination may improve safety when climbing the stairs of the system 900 in dark or dim ambient light conditions. In some examples, the one or more lighting assemblies 900 may be sensitive to pressure, and may illuminate when pressure is detected (e.g., when a user steps on the corresponding lighting assembly or step of the system 900).

In some examples, the systems discussed herein can include a communications unit that can be used to communicate (e.g., provide information concerning the system or its use) with one or more other devices or systems (e.g., security systems, lighting systems, communications networks, computing devices, mobile computing devices (e.g., smartphones, tablet computing devices, laptop computers, wearable computing devices (e.g., smart-watch, smart-bracelet), personal digital assistants, or the like, and smart-appliances, or the like).

Figure 10:
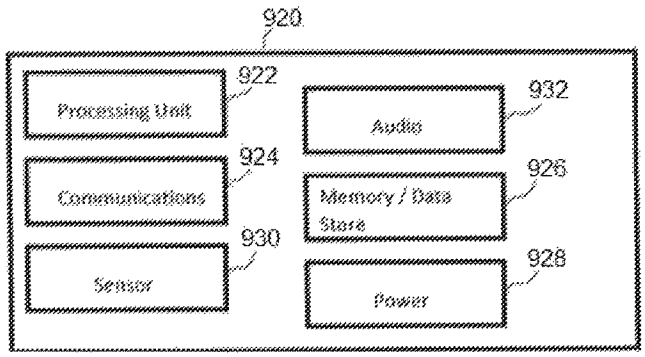
FIG. 10 is a block diagram of an example communication system that can be included with an example modular system.

FIG. 10 is a block diagram of a communications unit 920 that includes a processing unit 922, a communications module 924, memory (including a data store in some examples) 926, and a power unit 928. The processing unit 922 may include one or more microcontrollers, digital signal processors, or microprocessors in some examples, and may execute instructions stored in memory 926 to perform tasks for the communications unit 920. The communications module 924 may include a transmitter that can be used to wirelessly transmit information, for example over one or more communications networks (e.g., local area networks (LANs), wide area networks (WANs), the Internet, Wi-Fi networks, cellular networks, virtual private networks (VPNs), mobile data networks (e.g., 3G/4G networks, combinations of the foregoing, or others)), or in some examples via wired communications. In some examples, the communications module 924 includes a receiver that can be used to receive messages from other devices or systems. The memory 926 may include one or more of types of volatile memory or non-volatile memory, including in various examples, random-access memory (RAM), read-only memory (ROM), flash memory, storage devices (e.g., solid-state hard drive, hard disc drive) and/or other forms of volatile or non-volatile memory.

The power unit 928 may provide one or more power supply voltages to power components of the communications unit 920. In some examples, the power unit 928 can receive alternating current (AC) power, as from a wall outlet, and can convert the AC power into supply voltages usable by the communications unit 920. In some examples, the power unit includes a battery, which in some examples may be rechargeable.

Some examples of communications unit 920 can include one or more sensors 930, such as one or more sensors that can detect when a user is standing on one or more steps of the system. In some examples, the sensor 930 may sense pressure. In some examples, the sensor 930 may sense vibration. Such a sensor may be useful for detecting, for example, when a person (e.g., a young child) gets out of their bed during the night.

Some examples of communications unit 920 can include an audio unit 932, which can include one or more audio speakers, and can be used to provide an audio message, information, or the like. For example, the audio unit 932 may in some examples play an audio message that indicates the step (e.g., "1st step," "2nd step," "3rd step," or "top step," "middle step," "bottom step") that the user is standing on as the user ascends or descends the stairs of the system. In some examples, the audio unit 932 may play a song or music (e.g., a children's song or a lullaby), for example as a reward for a child climbing the stairs and going to bed in the evening. In some examples, the communications unit 920 may include a timer or timing device (or may obtain the current time via the communications module 924 (e.g., by querying a timing system), and may use the timer to provide appropriate messages (e.g., for particular times or blocks of time during the day).

In some examples, the communications unit 920 can provide an alarm, for example to parents when a child is detected getting out of bed during the night. The sensor 930 may detect that the child is descending the stairs of the system, for example, and the communications module 924 may send a message for receipt by another device or system (e.g., a phone or smartphone of a parent, a security system, a monitor in parents' bedroom, or the like). In some examples, the communications unit 920 can communicate with a lighting system and cause a light to turn on (or turn off) based on a detected action. For example, when the communications unit 920 (e.g., sensor 930) detects that a person is standing on the top step of the system (or on another step of the system, e.g., bottom step or an intermediate step), the communications unit 920 (e.g., communications module 924) can send a command to a lighting system to turn on a light in the room or in another room.

The communications unit 920 may be housed in an enclosure, which may be located, for example, underneath or mounted to an underside of one of the shelf components (e.g., component 102) of the system, according to some implementations.

FIG. 11A is a side view of an example post 1000. In various examples, post 1000 may be the same or similar as other posts described herein, such as post 104 or the posts depicted in FIGS. 8A-8D. A first portion 1001 of the post 1000 has a wider diameter 1002 (labeled "A" in FIG. 11A) than a second portion 1003 of the post 1000, which has a narrower diameter 1004 (labeled "B" in FIG. 11A). FIG. 11B is a perspective view of the post 1000.

FIGS. 11C, 11D, 11E, and 11F are views of example posts 1010 and 1020 that include a locking feature. FIG. 11C is a side view of an example post 1010. In various examples, post 1010 may be the same or similar as other posts described herein, such as post 104 or the posts depicted in FIGS. 8A-8D. The post 1010 includes a tab 1012 near a first end of the post 1010 and a slot 1014 near an opposite end of the post 1010. In the depicted example, the tab 1012 is located on the narrower portion of the post, and the slot 1014 is located on the wider portion of the post, but in other examples the tab 1012 may be located on the wider portion of the post and the slot 1014 may be located on the narrower portion of the post. When the narrower end of a first post 1010 is inserted into a wider end of a second post 1010, the tab 1012 of the first post 1010 may be received in the slot 1014 of the second post, which may releasably lock the first post and the second post together. Used with the other shelving components discussed herein, posts 1010 may be used to increase the sturdiness of assembled structures, for example. FIG. 11D is a perspective view of the post 1010.

FIG. 11E is a side view of an example post 1020. In various examples, post 1020 may be the same or similar as other posts described herein, such as post 104 or the posts depicted in FIGS. 8A-8D. The post 1020 includes a protrusion 1022 near a first end of the post 1020 and an aperture 1024 near an opposite end of the post 1020. In the depicted example, the protrusion 1022 is located on the narrower portion of the post, and the aperture 1024 is located on the wider portion of the post, but in other examples the protrusion 1022 may be located on the wider portion of the post and the aperture 1024 may be located on the narrower portion of the post. When the narrower end of a first post 1020 is inserted into a wider end of a second post 1020, the protrusion 1022 of the first post 1020 may be received in the apertures 1024 of the second post, which may releasably lock the first post and the second post together. Used with the other shelving components discussed herein, posts 1020 may be used to increase the sturdiness of assembled structures, for example. FIG. 11F is a perspective view of the post 1020.

Using the posts of FIGS. 11C-11F, a narrower portion of a first post can lock to a wider portion of another post. In some examples, the narrower portion of the first post can also lock with a shelf component. For example, some implementations of the shelf components discussed herein (e.g., component 102, component 1050, or other components discussed herein) can include a locking feature (e.g., a slot or an aperture) configured to engage the tab 1012 or protrusion 1022 on the posts 1010 or 1020, respectively. In some examples (not shown) the wider portion of the post 1010 or 1020 can include a tab or protrusion that can lock with the shelf component.

Figure 12B:
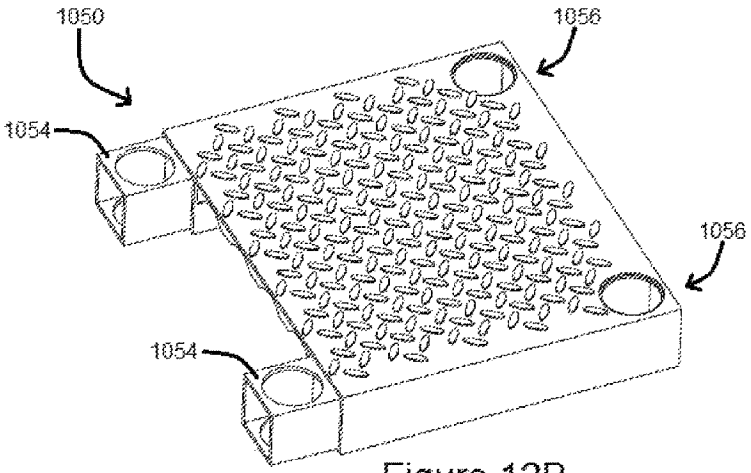
FIGS. 12A, 12B, 12C, and 12D are views of an example shelf component.
Figure 12A:
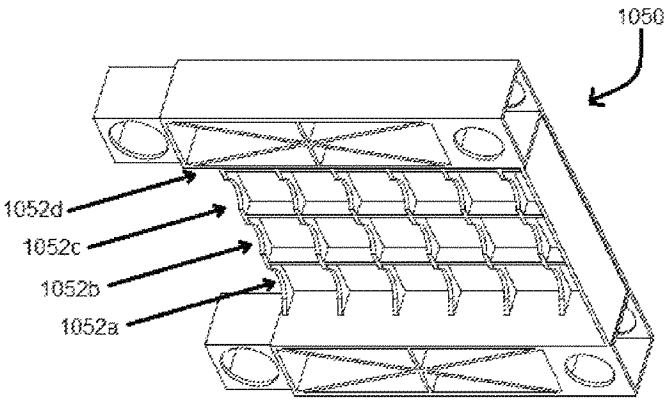
Figure 12C:
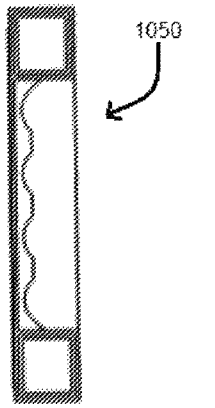
Figure 12D:
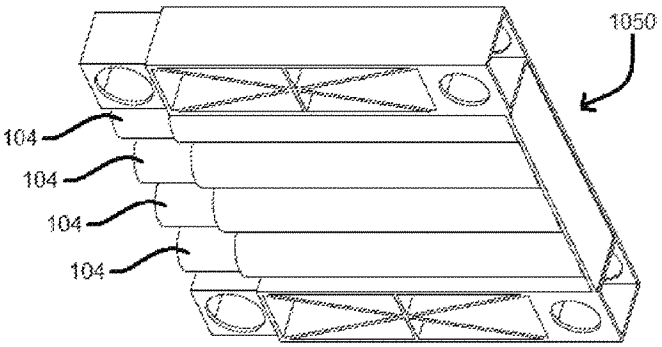

FIGS. 12A, 12B, 12C, and 12D are views of an example shelf component 1050. In various examples, shelf component 1050 may be similar to shelf component 102 (see FIG. 1), and may be used with the assembly 100 described above. FIG. 12A is a perspective view of an underside of the example shelf component 1050. Disposed on the underside of the component 1050 are a plurality of post-receiving features 1052*a*, 1052*b*, 1052*c*, and 1052*d* (feature 1052*d* obscured by a portion of the component 1050 in FIG. 12A). In some examples, a post-receiving feature may be configured to provide a compression fit to secure a post, such as when the components of an assembly are being stored or transported. FIG. 11C is an end view of the shelf component 1050, and depicts the post-receiving components 1052*a-d*. FIG. 11D is a perspective view of the underside of the component 1050, with a plurality of posts 104 shown received by the post-receiving features 1052*a*, 1052*b*, 1052*c*, and 1052*d*.

FIG. 12B is a perspective view of the shelf component 1050. In some examples, a top surface of the shelf component 1050 includes a non-slip surface or a textured surface, such as shown in FIG. 12B. Similar to the shelf component 102, shelf component 1050 includes a male end and a female end, albeit with slightly different configurations as compared to component 102. For example, shelf component 1050 includes voids 1056 at the female end of the component 1050 that extend inwardly from the female end of the component 1050, and protrusions 1054 that protrude from the male end of the component 1050. The voids 1056 are sized and shaped to receive the protrusions 1054 of the components 1050 (e.g., the protrusions 1054 of another shelf component 1050). The protrusions 1054 are shaped to be smaller in their width and height than the main body of the components 1050, which can permit the protrusions 1054 to be inserted into the voids 1056 in the female end of the components 1050 (e.g., into the voids 1056 of another shelf component 1050).

The components 1050 additionally include apertures that are defined by openings in the top and bottom surfaces of the components 1050 at the female end, and in the top and bottom surfaces of the protrusions 1054 at the male end, where the apertures extend through the height of the components 1050. The apertures can be sized and shaped to fit the posts 1062 (or other posts described herein), which can be received by the apertures.

Figure 15B:
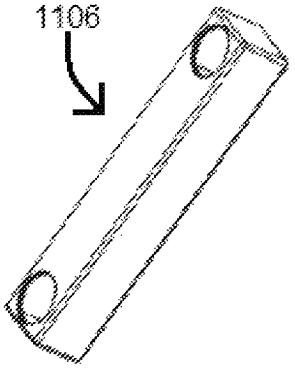
FIGS. 15A and 15B are perspective views of an example female end cap.
Figure 15A:
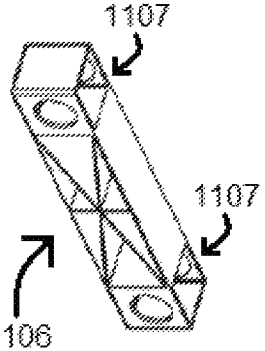

FIGS. 15A and 15B are perspective views of an example female end cap 1106 that can be used to cover an exposed male end of the first component 1050 on each row of a system constructed with components 1050 and posts. The female end cap 1106 defines voids 1107 that are similar in size and shape to the voids defined in the female ends of the components 1050 so as to permit receipt of the protrusions 1054 of the male ends of the components 1050. The female end caps 1106 can also include apertures and can be secured to the appropriate components 1050 by being first receiving protrusions 1054 of a male end of the components 1050 and then by posts (e.g., posts 104) being inserted and through the overlapping apertures of the components 1050 and the end caps 1106. The end caps 1106 can provide a variety of benefits, including improving the structural integrity and strength of the system. A male end cap (not shown) that includes protrusions similarly sized to protrusions 1054 of component 1050, with apertures defined through the protrusions, and a rear portion of the male end cap. The male end cap can be inserted into a last component 1050 with an exposed female end on each row of an assembly, and secured with posts in similar fashion as described above with reference to the male end caps of FIG. 1.

Figure 14B:
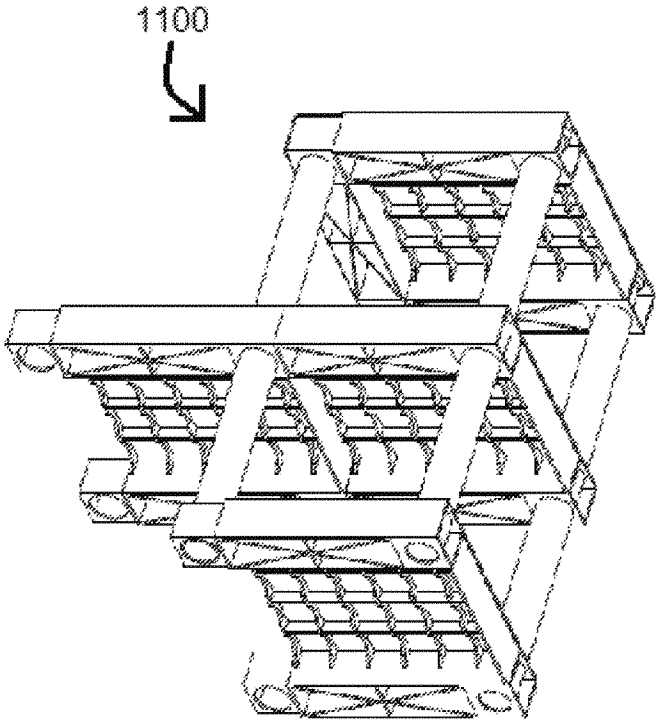
FIGS. 14A and 14B are perspective views or portions of an example modular system with interlocking shelf components and posts.
Figure 14A:
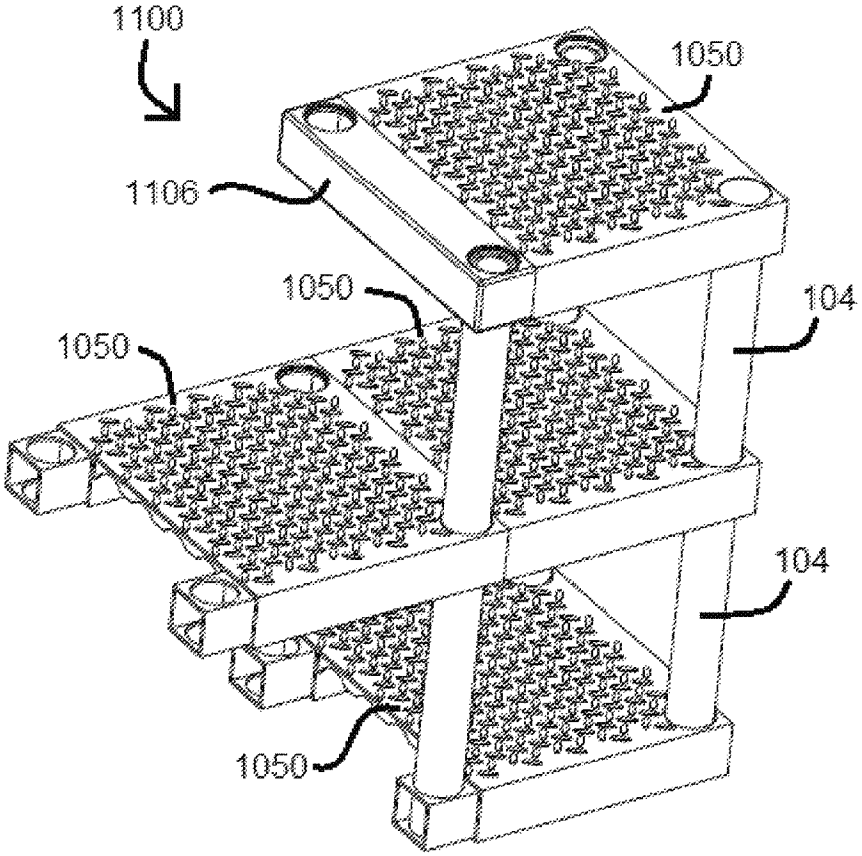

FIGS. 14A and 14B are perspective views or portions of an example modular system with interlocking shelf components 1050 and posts 104. A female end cap 1106 is shown covering a male end of the top shelf component 1050.

Figure 13B:
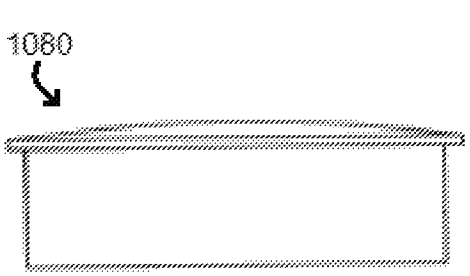
FIG. 13A is a perspective view and FIG. 13B is a side view of an example cap.
Figure 13A:
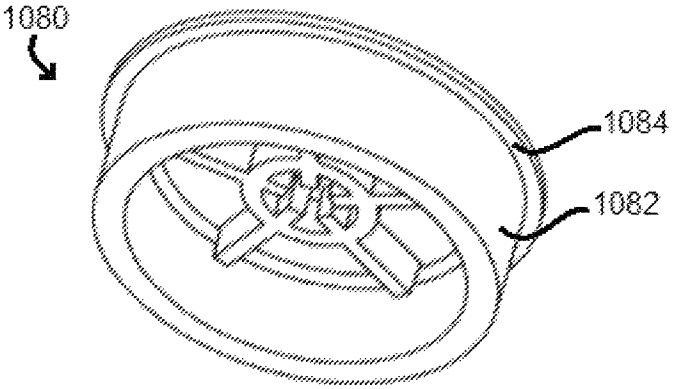

FIG. 13A is a perspective view and FIG. 13B is a side view of an example cap 1080. A lower portion 1082 of the cap 1080 that can be received in an aperture on the top-side of the components 1050. The cap 1080 defines a lip 1080 that can rest against the upper surface of the components 1050, for example. In some examples, cap 1080 can include one or more light bulbs or other appropriate lighting elements (e.g., located on an underside of the cap) to provide light for the assembly. In some examples, cap 1080 can include a solar- or light-energy collection device that can be used to power the light bulb or other appropriate lighting element.

The above description provides examples of some implementations. Other implementations that are not explicitly described above are also possible, such as implementations based on modifications and/or variations of the features described above. For example, the techniques described above may be implemented in different orders, with the inclusion of one or more additional steps, and/or with the exclusion of one or more of the identified steps. Similarly, the systems, devices, and apparatuses may include one or more additional features, may exclude one or more of the identified features, and/or include the identified features combined in a different way than presented above. Features that are described as singular may be implemented as a plurality of such features. Likewise, features that are described as a plurality may be implemented as singular instances of such features. Additionally, the steps and techniques described above as being performed by some computing devices and/or systems may alternatively, or additionally, be performed by other computing devices and/or systems that are described above or other computing devices and/or systems that are not explicitly described. The drawings are intended to be illustrative and may not precisely depict some implementations. Variations in sizing, placement, shapes, angles, and/or the positioning of features relative to each other are possible.

What is claimed is:

1. A modular shelving assembly comprising:

a plurality of shelving components that each include:

a body, a male portion that extends from a first end of the body, the male portion having width and height dimensions that are both smaller than width and height dimensions of the body, a female portion that defines a void in a second end of the body that is opposite the first end of the body, the female portion being sized and shaped to receive the male portion of another said shelving component, first apertures defined by and extending through the male portion, and second apertures defined by and extending through the female portion;

a plurality of posts that are sized and shaped to be inserted into overlapping apertures of said first and second apertures of a first shelving component and a second shelving component of said plurality of shelving components, the overlapping apertures comprising (i) a first aperture in the male portion of the first shelving component that has been inserted into a female portion of the second shelving component and (ii) a second aperture in the female portion of the second shelving component;

a male end cap that includes a male portion that extends from a first end of the male end cap and that is configured to be inserted into an initial shelving component in a row of said shelving components with an open said female portion; and a female end cap that includes a female portion that defines a void and that is configured to receive a said male portion from a last shelving component in a row of said shelving components with an open said male portion.

2. The modular shelving assembly of claim 1, wherein the plurality of shelving components and posts are assembled into a plurality of rows, each of the rows including one or more of the shelving components.

3. The modular shelving assembly of claim 2, wherein, from at least a second row to a top row of the plurality of rows, the number of shelving components decreases by one shelving component for each successive row from the second row to the top row.

4. The modular shelving assembly of claim 3, wherein the plurality of rows comprise steps and shelves.

5. The modular shelving assembly of claim 1, wherein each post of the plurality of posts includes a first locking feature near a first end and a second locking feature near a second end, and wherein a first locking feature of a first post of the plurality of posts is configured to engage with a second locking feature of another post of the plurality of posts.

6. The modular shelving assembly of claim 5, wherein the first locking feature is a tab and the second locking feature is a groove.

7. The modular shelving assembly of claim 5, wherein the first locking feature is a protrusion and the second locking feature is a hole.

8. The modular shelving assembly of claim 1, further comprising one or more lighting members, wherein the one or more lighting members is selected from the group consisting of: a light strip, a light mat, and a light element sized for an aperture in the body of the shelving component.

9. The modular shelving assembly of claim 1, wherein at least one of the shelving components includes, on an underside of said body of said at least one of the shelving components, a plurality of post-receiving features, each configured to secure, for storage, a post of the plurality of posts.

10. The modular shelving assembly of claim 1, further comprising a panel that includes an attachment feature configured to secure the panel to at least one post of the modular shelving assembly.

11. The modular shelving assembly of claim 10, wherein the attachment feature is selected from the group consisting of: a hook configured for a compression fit with the post, a curved end configured for a compression fit with the post, and a tab sized to be received by a slit in the post.

12. The modular shelving assembly of claim 1, wherein the male portion comprises first and second extensions, and wherein the female portion comprises first and second voids.

13. The modular shelving assembly of claim 1, further comprising a railing attached to one or more shelving components of the modular shelving assembly.

14. The modular shelving assembly of claim 1, wherein each shelving component in the plurality of shelving components has a rectangular shape.

15. The modular shelving assembly of claim 1, wherein each shelving component in the plurality of shelving components has a wedge shape.

16. The modular shelving assembly of claim 1, wherein the first apertures comprise a top aperture of the male portion and a bottom aperture of the male portion, wherein the second apertures comprise a top aperture of the female portion and a bottom aperture of the female portion, and wherein the top aperture of the male portion and the top aperture of the female portion each have a first size, and the bottom aperture of the male portion and the bottom aperture of the female portion each have a second size that is larger than the first size.

17. The modular shelving assembly of claim 16 wherein, for at least one post of the plurality of posts, a top portion of the post is sized larger than a bottom portion of the post.

18. The modular shelving assembly of claim 1, wherein the first apertures comprise a top aperture of the male portion and a bottom aperture of the male portion, wherein the second apertures comprise a top aperture of the female portion and a bottom aperture of the female portion, and wherein the top aperture of the male portion and the top aperture of the female portion each have a first size, and the bottom aperture of the male portion and the bottom aperture of the female portion each have a second size that is smaller than the first size.

19. The modular shelving assembly of claim 18 wherein, for at least one post of the plurality of posts, a top portion of the post is sized smaller than a bottom portion of the post.

20. The modular shelving assembly of claim 1, wherein the initial shelving component is the first shelving component, and wherein the last shelving component is the second shelving component.

* * * * *